US006305586B1

(12) United States Patent
Wong

(10) Patent No.: US 6,305,586 B1
(45) Date of Patent: Oct. 23, 2001

(54) HANGER CLIP GRIP PAD

(75) Inventor: Eddie Wong, Kowloon (HK)

(73) Assignee: Randy Hangers, East Rutherford, NJ (US)

( * ) Notice: Subject to any disclaimer, the term of this patent is extended or adjusted under 35 U.S.C. 154(b) by 0 days.

(21) Appl. No.: 09/761,412

(22) Filed: Jan. 16, 2001

(51) Int. Cl.[7] ..... A47G 25/48; A47G 25/14
(52) U.S. Cl. ..... 223/96; 223/93; 223/91
(58) Field of Search ..... 223/96, 93, 91, 223/90; 24/507, 536

(56) References Cited

U.S. PATENT DOCUMENTS

D. 299,086 12/1988 Wilson .
4,049,163 * 9/1977 Stolz ..... 223/96
4,194,274 3/1980 Garrison .
4,716,634 1/1988 Fan .
5,020,705 * 6/1991 Garrison ..... 223/96
5,178,306 * 1/1993 Petrou ..... 223/96
5,267,678 12/1993 Zuckerman .
6,105,836 * 8/2000 Batts et al. ..... 223/96
6,119,906 * 9/2000 Bond et al. ..... 223/96

* cited by examiner

*Primary Examiner*—Bibhu Mohanty
(74) *Attorney, Agent, or Firm*—Helfgott & Karas, P.C.

(57) ABSTRACT

A clip for a garment hanger is provided with a pair of clip jaws having gripping pads provided thereon. At least one gripping pad on one clip jaw is further provided with a retention member that preferably overlies or extends over the peripheral edge of the other gripping pad on the other clip jaw while the clip is in the closed position. The retention member effectively inhibits a garment secured between such clip jaws and gripping pads from falling through the clip jaws, or from being pulled or otherwise drawn past the gripping pads while the clip is in the closed position.

40 Claims, 7 Drawing Sheets

HANGER CLIP GRIP PAD

FIELD OF THE INVENTION

The present invention relates in general to clips for clamping garments to clothes hangers, and relates in particular to such clips provided with gripping pads having overlies for inhibiting removal of garments secured between such clips.

BACKGROUND OF THE INVENTION

Conventional hanger clips comprise a pair of pivotally biased clip jaws that are movable from a closed position, for the securement of a garment therebetween, to an open position for the release of such garment from such jaws or for the initial positioning of such garment between such jaws. Each clip jaw may be further provided with a rubber-like grip pad that is usually adhered to the inner surface of such jaw. Such grip pads are known to enhance the grip upon clothing items retained therebetween.

In certain situations, particularly with lightweight clothing and garments manufactured from a silk or satin type material, the grip pads may be insufficient or ineffective in maintaining the clothing secured between clip jaws. Such clothing may, for example, slip from between the clip jaws and grip pads under the mere force of gravity. In other cases, the slightest tug upon the garment might cause it to fall. In stores where clothing items are presented on racks and the like, the constant movement of such garments along the rack guides and the constant grasping of such garments for purposes of temporarily separating and selective viewing from the rack (without actually removing the garment from the rack) can cause ineffectively gripped clothing items to cascade off their hangers. This unfortunately leads to undesirable contact of the clothing items with the ground, repeated bending motions for the retrieval of such clothing items and repeated finger compressions for their eventual reattachment to the hanger clips. More importantly, however, such distractions can seriously detract from one's shopping experience, resulting in frustrated expectations and hopes unrealized.

Accordingly, a need exists for a garment clip that can reliably secure any type of garment without regard to the type or weight of material. A further need exists for a garment clip that prevents removal of secured garments under the influence of a downward force.

OBJECTS OF THE INVENTION

It is an object of the present invention, therefore, to provide a garment clip that can reliably secure a garment therebetween.

It is a further object of the present invention to provide a garment clip that prevents removal of a garment under the influence of a tugging or downward force.

It is a still further object of the present invention to provide a garment clip having a gripping pad with improved retention abilities.

It is a still further object of the present invention to provide a garment clip having a gripping pad with a retention member that inhibits removal of a garment secured within said clip.

It is a still further object of the present invention to provide a garment clip having a gripping pad on each clip jaw with a retention member provided on one clip jaw gripping pad that overlies or extends over the peripheral edge of the other clip jaw gripping pad.

Still other objects and advantages of the invention will become clear upon review of the following detailed description in conjunction with the appended drawings.

SUMMARY OF THE INVENTION

A clip for a garment hanger, such clip being movable between a closed position for the securement of a garment and an open position for the release of a garment, is provided with a pair of clip jaws having gripping pads provided thereon. At least one gripping pad on one clip jaw is further provided with a retention member that preferably overlies or extends over the peripheral edge of the other gripping pad on the other clip jaw while the clip is in the closed position. The retention member effectively inhibits a garment secured between such clip jaws and gripping pads from being pulled or otherwise drawn past the gripping pads while the clip is in the closed position. Such retention member also prevents a clothing item from escaping the grip of the clip jaws under limited forces such as the weight of the clothing item alone.

DETAILED DESCRIPTION OF THE PREFERRED EMBODIMENTS

Figure 1:
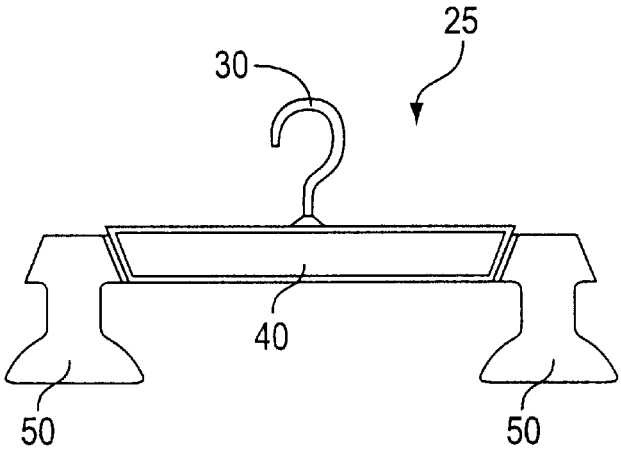
FIG. 1 is a schematic front elevation view of a garment hanger having a plurality of garment clips constructed in accordance with the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 shows a garment hanger 25 having a hook 30, a hanger arm 40 and a pair of hanger garment clips 50 provided on opposite ends of the hanger arm 40. The hanger arm and garment clips are preferably formed from a rigid plastic such as a thermoplastic elastomer.

Figure 2A:
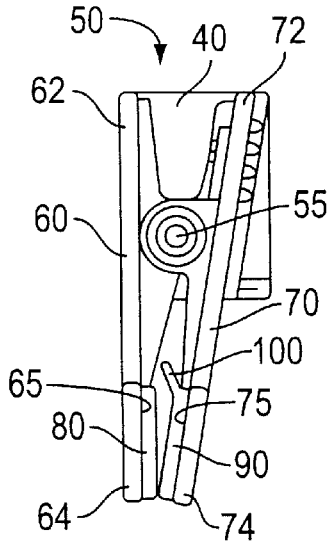
FIG. 2A is a left end view of a garment clip in the closed position and having grip pads that abut along their free ends.
Figure 3:
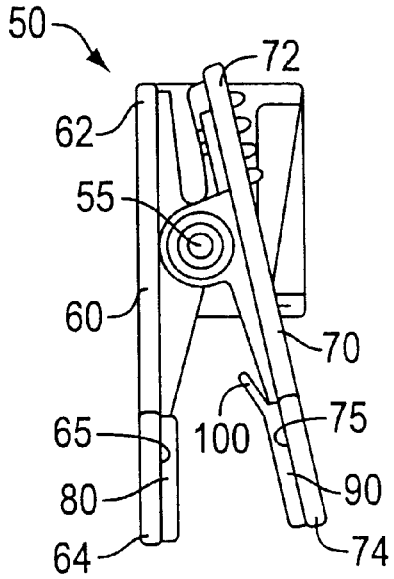
FIG. 3 is a view of the clip of FIG. 2A in the open position.

FIG. 2A is a left end view of a garment clip 50 in the closed position, while FIG. 3 shows the garment clip 50 of FIG. 2A in the open position. The garment clip 50 is formed from clip jaws 60 and 70 engaged along a pivotal location 55, with each clip jaw having an engagement end 62, 72 for compressive engagement by a human hand and a clamping end 64, 74 for clamping around a garment (not shown in FIG. 1). Such clip jaws 60, 70 are preferably also spring biased into the closed position around such pivotal location 55 with the use of a spring (not shown) attached to each clip jaw 60, 70 about such location 55.

It should be noted that the basic parts and structure of the garment hanger 25 and clips 50 used for purposes of illustration in this application are similar to the hanger and clips of the present assignee's U.S. Pat. No. 6,023,819 issued Feb. 15, 2000. In this regard, the clip 50 of the present invention is shown with one clip jaw 60 fixed to the hanger arm 40 and one clip jaw 70 pivotable a shaft 55 that is also coupled to the hanger arm 40. It will be understood, however, that such illustrations are not meant to be limiting in any respect as will be seen in later figures showing alternative garment clip constructions.

Returning to FIG. 2A, the clamping ends 64, 74 of clip jaws 60, 70 are provided with grip pads 80, 90 preferably formed from, but not limited to, a PVC material, an SBS (styrene-butadiene-styrene) material such as Krayton®, or the like, which are preferably adhered to the inner surfaces 65, 75 of the clamping ends 64, 74 with adhesive or the like. Other methods of attaching the grip pads to the clip jaws, such as, for example, by co-molding or by purely mechanical means that avoid the need for adhesives or the like, may be used as desired. It is desirable to form the grip pads out of the above mentioned materials because such material is both resilient and tacky, which enhances the retention of a garment clamped between the grip pads as shown and described in connection with FIG. 4.

Figure 2B:
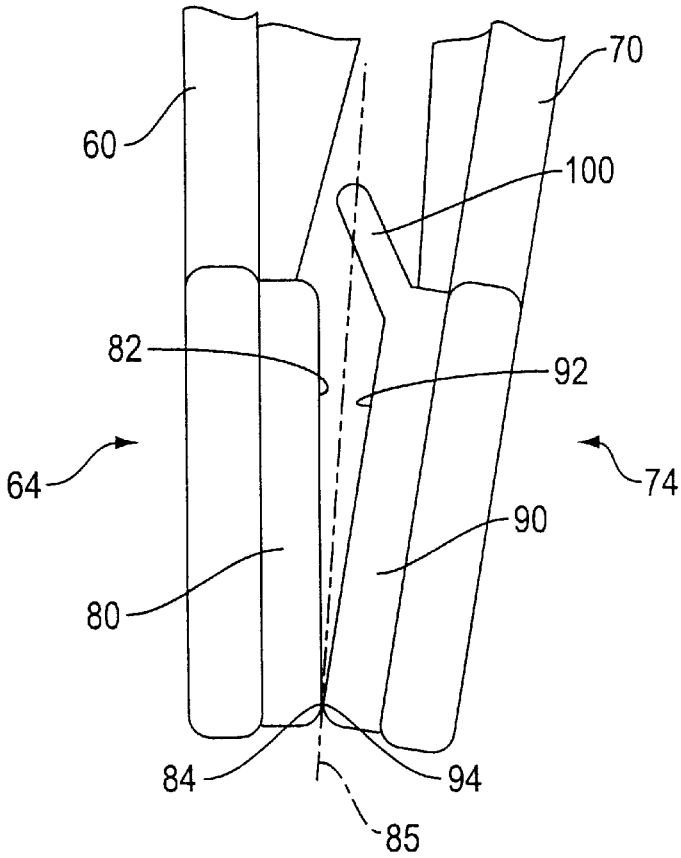
FIG. 2B is a close up view of the clamping end of the garment clip of FIG. 2A.

As shown in FIG. 2B, which is a close up view of the clamping end of the garment clip 50 of FIG. 2A, each grip pad 80, 90 has a peripheral edge 82, 92 extending around its exposed surfaces. The pads 80, 90 in the embodiment of FIGS. 2A through 5 abut only at their free ends 84, 94 which lie along a plane of engagement 85 therebetween. At least one pad, shown in FIGS. 2A through 5 as pad 90, and in an alternative embodiment in FIG. 13 as the opposing pad 80, is provided with an extension or a retention member 100 that extends outwardly at an angle toward the opposing grip pad 80. Such extension or retention member 100 is preferably resilient, flexible or bendable and integrally formed with such pad 90, although it may also constitute an element separate from such pad as desired. Such extension or retention member also preferably extends across the plane of engagement 85 defined by the abutment of the grip pads 80, 90 and overlies the opposing pad 80 while the garment clip is in the closed position. The benefit attributed to the retention member 100 will be described in connection with FIGS. 4 and 5.

Figure 4:
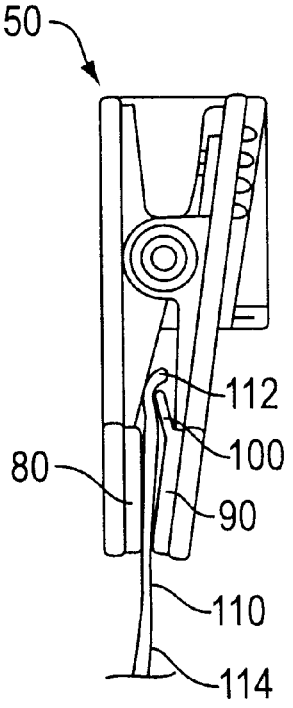
FIG. 4 is the clip of FIG. 2A with a garment retained between the clip jaws.
Figure 5:
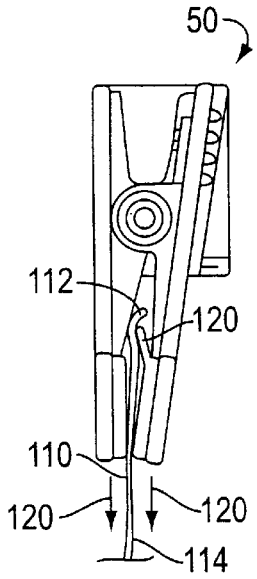
FIG. 5 illustrates the garment shown in FIG. 4 being pulled downward and retained by the garment clip.
Figure 6A:
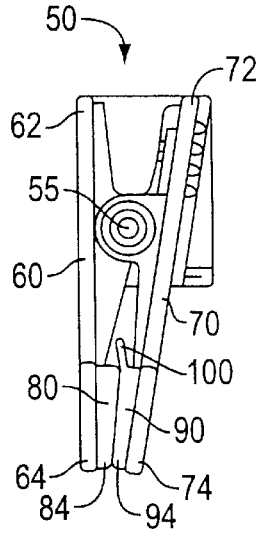
FIG. 6A is a left end view of a garment clip of the invention having grip pads that abut over substantially their entire surface.
Figure 6B:
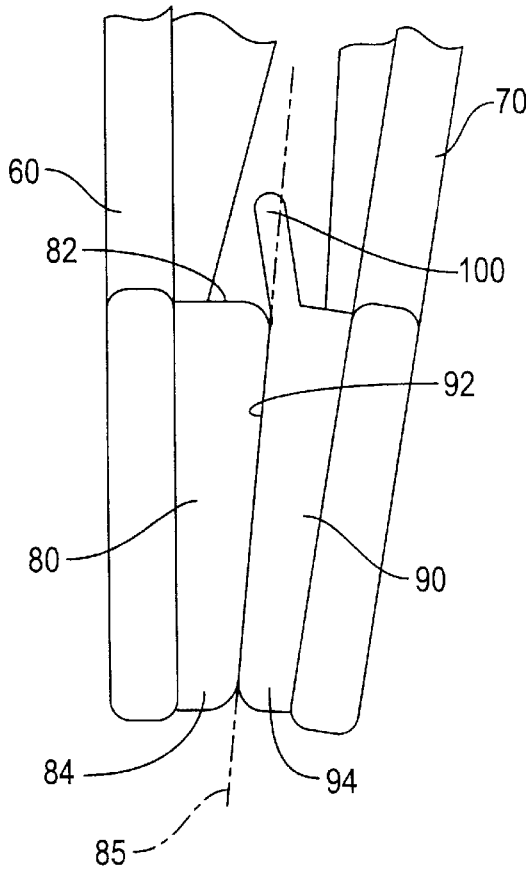
FIG. 6B is a close up view of the clamping end of the garment clip of FIG. 6A.
Figure 7:
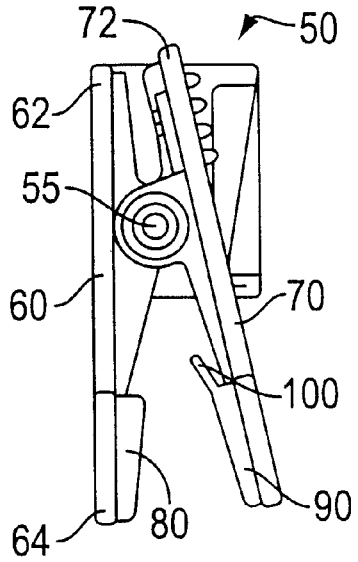
FIG. 7 is a view of the clip of FIG. 6A in the open position.
Figure 8:
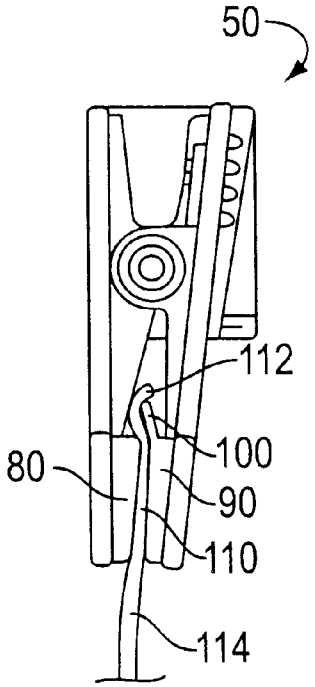
FIG. 8 is the clip of FIG. 6A with a garment retained between the clip jaws.
Figure 9:
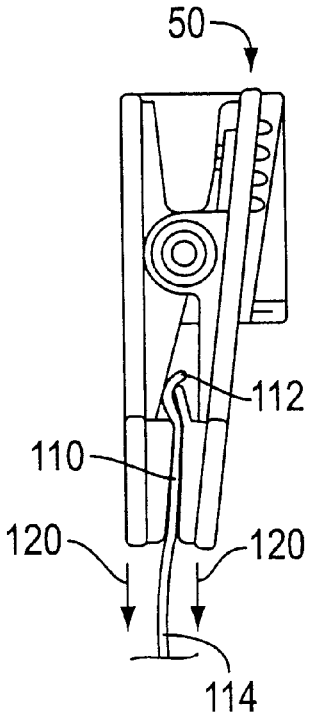
FIG. 9 illustrates the garment shown in FIG. 8 being pulled downward and retained by the garment clip.

FIG. 4 illustrates a garment 110 retained by the clip 50 of FIG. 2A. Garment 110 has a portion 112 that extends above the abutting grip pads 80, 90 and beyond the retention member 100, and another portion 114 that extends below the clip 50. The positioning of the garment portion 112 above the retention member 100 in conjunction with the clamping of such garment 110 between grip pads 80, 90 inhibits downward displacement of the garment 110 through the clamped clip jaws 60, 70. One reason for this inhibition is that by extending the retention member 100 across the plane of engagement 85 and over the peripheral edge of the opposing pad 80, the garment is no longer provided with a straight, downward path through the garment clip. Instead, the retention member 100 interrupts such path, causing the garment 110 to effectively detour around the retention member 100. When a downward force 120 is applied to the lower portion 114 of the garment 110 as shown in FIG. 5, whether such force 120 is merely the weight of the garment 110 or an external force equal to a pull or a tug, such force is transmitted in part to and through the retention member 100 through the upper portion of the garment 112 lying thereagainst. This force transmission inhibits or otherwise prevents the downward force 120 from causing the upper portion 112 of the garment 110, and therefore the garment 110 as a whole, from slipping through the grasp of the gripping pads 80, 90. Thus, the retention member 100 provides a deviation in the otherwise uninterrupted displacement path along the gripping pads through which a garment would travel if pulled, with such retention member accepting and transmitting part of the downward pulling force that would normally be experienced solely by the garment itself.

FIGS. 6A through 9 show an alternative embodiment to FIGS. 2A through 5, wherein grip pads 80, 90 abut substantially along the plane of engagement 85 (FIG. 6B) or along their engagement surfaces as a result of such grip pads 80,90 having a non-uniform thickness. The grip pads 80, 90 in such embodiment are thinnest near their free ends 84, 94 and increase in thickness in the direction of the attachment location 55. It is preferable to have the grip pads abut over a larger surface as shown in FIGS. 6A through 9, as opposed to only along their free ends 84, 94 as shown in FIGS. 2A through 5, because a garment 110 retained between such grip pads 80, 90 (FIGS. 8 and 9) is effectively clamped over a larger surface area, which further inhibits the removal of such garment 110 through the grasp of the grip pads. The overlie portion 100 extending from pad 90 as shown in FIG. 6B extends over and across the plane of engagement 85 and overlies the peripheral edge 82 of the opposing grip pad 80, thereby creating the same detour conditions as previously illustrated and discussed in connection with FIGS. 5 and 6A.

Figure 10:
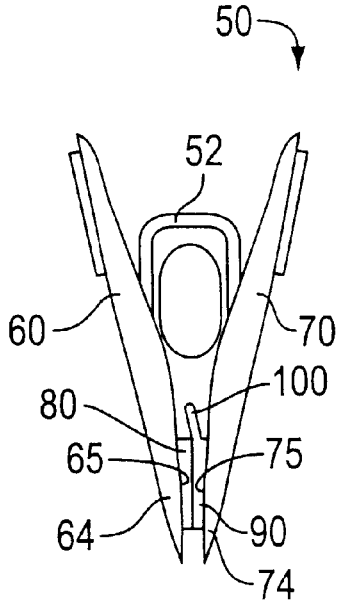
FIGS. 10 through 12 are left ends views of alternative embodiments of garment clip constructions incorporating the grip pads of the present invention.
Figure 11:
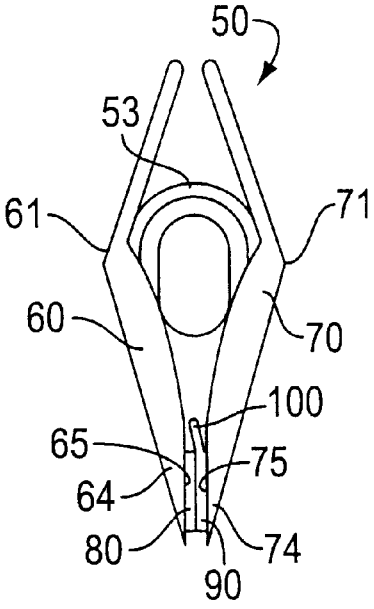
Figure 12:
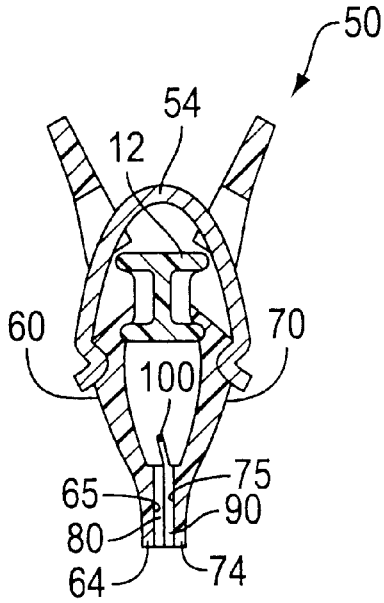

In FIGS. 6A through 9, the extent and angle of the thickness variation in each grip pad such that both grip pads abut along a vertical plane of engagement will depend on the angular relationship between the clip jaws 60, 70 along their clamping ends 64, 74. In FIGS. 2A through 9, the longitudinal axis of clip jaw 70 is angled with respect to the longitudinal axis of the clip jaw 60 along their respective clamping ends 64. 74. However, if the longitudinal axes along the clamping ends 64 and 74 were substantially parallel, the variation in thickness would not be that severe. For example, FIGS. 10 through 12 show alternative embodiments of garment clips 50 incorporating the grip pads 80, 90 and retention member 100 of the present invention, having clamping ends 64, 74 with substantially vertical inner surfaces 65, 75. This arrangement reduces the thickness variation along the grip pads. The garment clip of FIG. 10, for example, is generally constructed in accordance with European Patent 8909821.4, with clip jaws 60 and 70 biased together by spring 52. The garment clip of FIG. 11, for example, shows a pair of clip jaws 60, 70 having release guard portions 61, 71 biased together by spring 53, while the garment clip of FIG. 12, for example, is slidably retained on the hanger bar 12, with clip jaws 60, 70 pivotable around the hanger bar 12 and attached at the hanger bar by a spring clip 54. Each clip illustrated in FIGS. 10 through 12 is enhanced with a retention member 100 extending from one of the grip pads.

Figure 13:
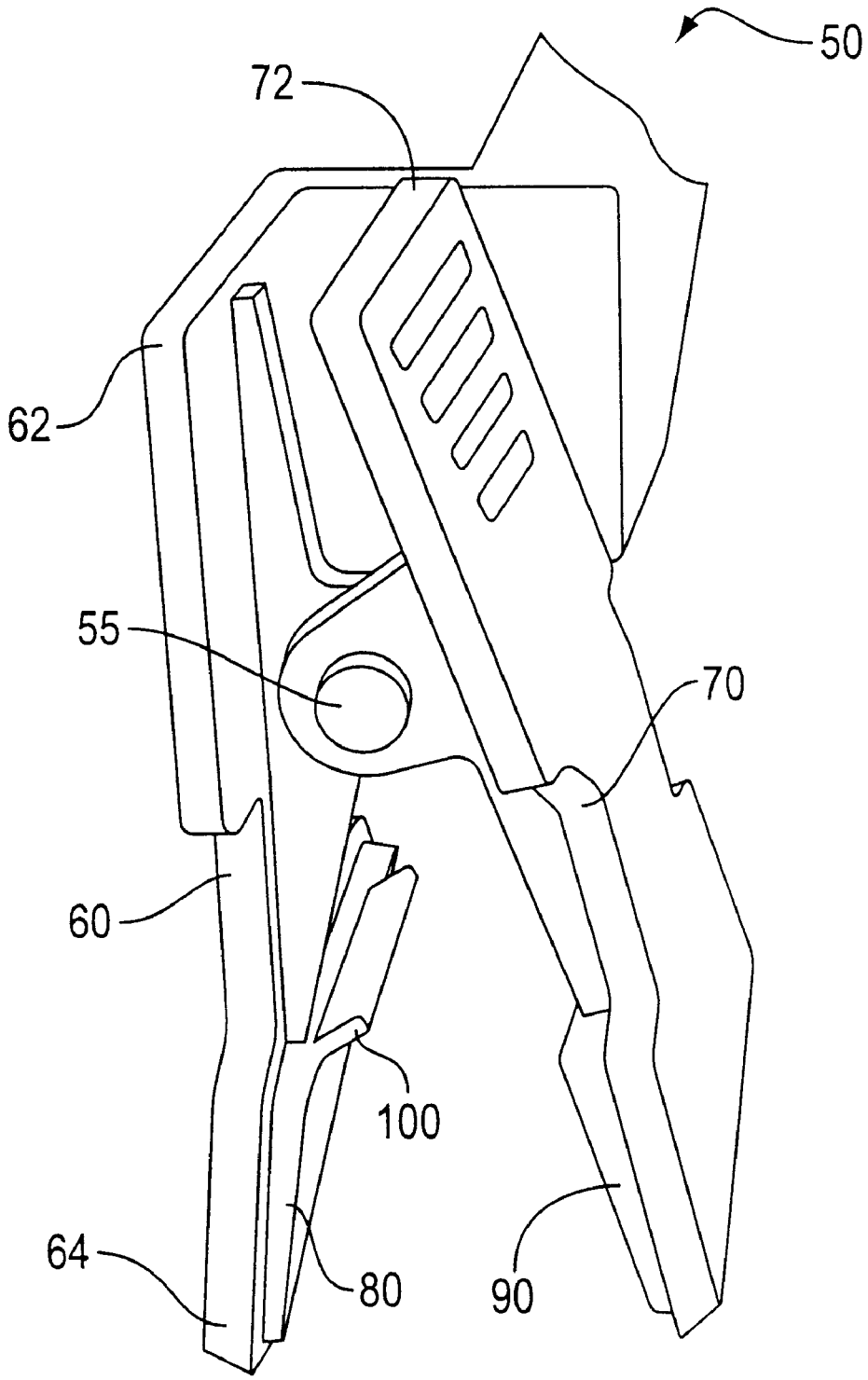
FIG. 13 is a perspective view of an alternative embodiment of the clip of FIG. 2A, but with the gripping pad extension on the opposing grip pad.

FIG. 13, as discussed above, illustrates the placement of the retention member 100 on the grip pad 80, which is opposite from the placement on the grip pad 90 as shown in previous figures. The present inventor has found that placement of the retention member 100 on either grip pad 80 or 90 will be satisfactory, as long as there is a retention member on at least one of the grip pads. Such retention member 100 is also shown extending along only a portion of grip pad 80 and not along the entire length thereof. However, such retention member 100 may also extend along the entire length of such grip pad 80 as desired.

Figure 14:
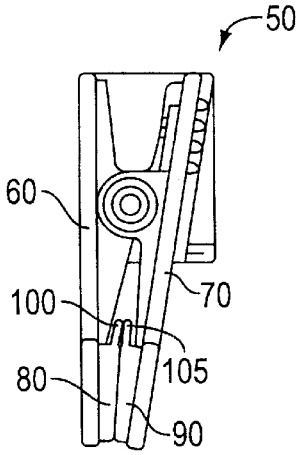
FIG. 14 is an alternative embodiment of a garment clip of the invention having grip pad extensions on each grip pad that are angled in the same direction.
Figure 15:
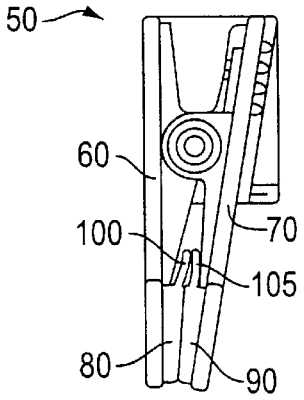
FIG. 15 is an alternative embodiment of a garment clip of the invention having grip pad extensions on each grip pad that are angled toward each other.
Figure 16:
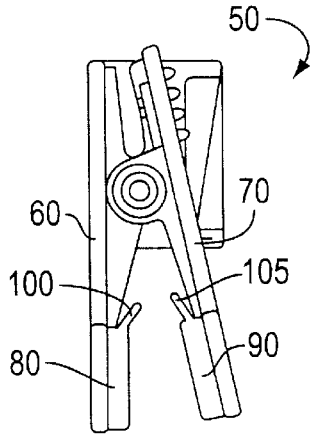
FIG. 16 is the clip of FIG. 15 in the open position.

FIG. 14 illustrates an alternative embodiment of a garment clip 50 with substantially abutting grip pads 80, 90 having retention members 100, 105 extending therefrom. While both retention members 100, 105 are shown in FIG. 14 angled in the same direction toward clip jaw 70, they could also be angled in the opposite direction toward clip jaw 60. Alternatively as shown in FIGS. 15 (closed position) and 16 (open position), retention members 100 and 105 could be angled toward each other. However, if retention members are to be angled toward each other, one retention member, shown in FIGS. 15 and 16 as retention member 105, should preferably be located inward along the grip pad 90 so that as least one of the retention members, shown in FIGS. 15 and 16 as retention member 100, extends across the plane of engagement when the clip is in the closed position (FIG. 15).

Figure 17:
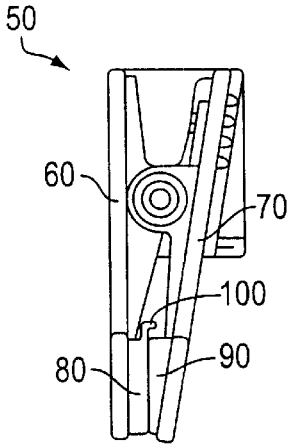
FIG. 17 is an alternative embodiment of a garment clip of the invention having a right-angle grip pad extension.

FIG. 17 illustrates yet an alternative embodiment of a garment clip 50 incorporating a right-angle grip pad extension 100 that overlies the other grip pad 90. The grip pad extension or retention member 100 can extend outwardly and at a variety of angles, so long as a detour-like condition is created to inhibit removal of a garment from the grasp of the garment clip.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A clip for a garment hanger movable between an open position and a closed position, said clip comprising:

a) a first clip jaw having a first grip pad with a peripheral edge, and b) a second clip jaw having a second grip pad with a peripheral edge, said second clip jaw being engaged at a pivotal location to said first clip jaw such that said first and second grip pads oppose each other, c) wherein a portion of at least one of said first or second grip pads extends over the peripheral edge of the other grip pad.

2. A clip in accordance with claim 1, wherein said first clip jaw is pivotally attached to said second clip jaw.

3. A clip in accordance with claim 1, wherein said first and second grips pads have a uniform thickness.

4. A clip in accordance with claim 1, wherein said first and second grips pads have a non-uniform thickness.

5. A clip in accordance with claim 4, wherein each of said first and second clip jaws has a free end farthest from said engagement location and wherein said first and second grips pads are the thinnest adjacent said free ends.

6. A clip in accordance with claim 1, wherein said first and second grip pads substantially abut each other while said clip is in the closed position.

7. A clip in accordance with claim 1, wherein said extension portion is integral with said at least one of said first or second grip pads.

8. A clip in accordance with claim 1, wherein said extension portion extends upwardly toward said engagement location.

9. A clip in accordance with claim 8, wherein said extension portion further extends at an angle toward the opposing clip jaw from said engagement portion.

10. A clip in accordance with claim 1, wherein said grip pads are integral with their respective clip jaws.

11. A clip in accordance with claim 1, wherein said grip pads are of a different material than said clip jaws.

12. A clip in accordance with claim 11, wherein said grip pads are formed from PVC.

13. A clip in accordance with claim 1, wherein said grip pads are co-molded with said clip jaws.

14. A clip in accordance with claim 1, wherein said clip jaws are spring biased into the closed position.

15. A clip for a garment hanger movable between a closed position for the securement of a garment and an open position for the release of a garment, said clip comprising:

a) a first clip jaw having a first grip pad, b) a second clip jaw having a second grip pad and engaged with said first clip jaw along a pivotal location, c) said first and second grip pads abutting each other in an opposing relationship along a plane of engagement while said clip is in the closed position, and d) a retention member provided on at least one of said first and second grip pads for inhibiting removal of a garment clipped between said clip jaws while said clip is in the closed position, e) wherein said retention member extends across said plane of engagement and beyond a peripheral edge of the other grip pad while said clip is in the closed position.

16. A clip in accordance with claim 15, wherein said retention member extends upwardly and at an angle from said grip pad toward the opposing clip jaw.

17. A clip in accordance with claim 15, wherein said first and second grips pads have a non-uniform thickness.

18. A clip in accordance with claim 15, wherein said first and second grip pads substantially abut each other while said clip is in the closed position.

19. A clip in accordance with claim 15, wherein said clip jaws are spring biased into the closed position.

20. A clip in accordance with claim 15, wherein said retention member is integral with said at least one of said first and second grip pads.

21. A garment hanger comprising a plurality of garment clips, each of said clips being movable between an open position and a closed position and each of said clips further comprising:

a) a first clip jaw having a first grip pad, b) a second clip jaw having a second grip pad and attached at an attachment location to said first clip jaw, and c) a retention member provided on at least one of said first and second grip pads that extends outwardly and at an angle toward said other grip pad for inhibiting removal of a garment clipped between said clip jaws while said clip is in the closed position, d) wherein said first and second grip pads have a peripheral edge and said retention member provided on at least one of said first and second grip pads extends over the peripheral edge of the other grip pad.

22. A garment hanger in accordance with claim 21, wherein said grip pads are formed from a different material than said clip jaws.

23. A garment hanger in accordance with claim 21, wherein said first and second grips pads have a non-uniform thickness.

24. A garment hanger in accordance with claim 21, wherein said first and second grip pads substantially abut each other while said clip is in the closed position.

25. A garment hanger in accordance with claim 21, wherein said grip pads are integral with said clip jaws.

26. A garment hanger in accordance with claim 21, wherein said grip pads are co-molded with said clip jaws.

27. A garment hanger in accordance with claim 21, wherein said clip jaws are spring biased into the closed position.

28. A garment hanger in accordance with claim 21, wherein said retention member is integral with said at least one of said first and second grip pads.

29. A garment hanger comprising a) a hanger arm having opposite ends, b) a hook provided on said hanger arm, c) a garment clip provided on each end, each clip being movable between an open position and a closed position and further comprising a first clip jaw having a first grip pad disposed thereon, said first grip pad having a peripheral edge, and a second clip jaw pivotal with said first clip jaw, said second clip jaw having a second grip pad disposed thereon, said second grip pad having a peripheral edge, d) a retention member extending from the peripheral edge of at least one of said first and second grip pads on each garment clip for inhibiting removal of a garment clipped between said clip jaws while said clips are in the closed position.

30. A garment hanger in accordance with claim 29, wherein said retention member on each garment clip extends toward the other grip pad.

31. A garment hanger in accordance with claim 29, wherein said retention member on each garment clip extends over the peripheral edge of the other grip pad.

32. A garment hanger in accordance with claim 29, wherein said first and second grips pads on each garment clip have a non-uniform thickness.

33. A garment hanger in accordance with claim 29, wherein said first and second grip pads on each garment clip substantially abut each other while said clips are in the closed position.

34. A garment hanger in accordance with claim 29, wherein at least one of said clip jaws is integrally formed with said hanger arm.

35. A garment hanger in accordance with claim 29, wherein said grip pads are co-molded with said clip jaws.

36. A garment hanger in accordance with claim 29, wherein said retention member is integral with said at least one of said first and second grip pads.

37. A garment hanger in accordance with claim 29, wherein said retention member extends from the peripheral edges of each grip pad.

38. A garment hanger in accordance with claim 37, wherein said retention members on each garment clip extend along the same direction.

39. A garment hanger in accordance with claim 37, wherein said retention members on each garment clip extend along different directions.

40. A garment hanger in accordance with claim 37, wherein said retention members on each garment clip extend toward each other.

* * * * *